US006298923B1

(12) United States Patent
Schmid et al.

(10) Patent No.: US 6,298,923 B1
(45) Date of Patent: Oct. 9, 2001

(54) IMPACTING DEVICE FOR RELEASING BLOCKED OBJECTS BY IMPACT

(75) Inventors: Wolfgang Schmid; Mirko Lysek, both of Munich (DE)

(73) Assignee: Wacker-Werke GmbH & Co. KG (DE)

( * ) Notice: Subject to any disclaimer, the term of this patent is extended or adjusted under 35 U.S.C. 154(b) by 0 days.

(21) Appl. No.: 09/380,991

(22) PCT Filed: Jun. 25, 1998

(86) PCT No.: PCT/EP98/03903

§ 371 Date: Sep. 9, 1999

§ 102(e) Date: Sep. 9, 1999

(87) PCT Pub. No.: WO99/04937

PCT Pub. Date: Feb. 4, 1999

(30) Foreign Application Priority Data

Jul. 23, 1997 (DE) ..... 197 31 732

(51) Int. Cl.[7] ..... B21J 7/02

(52) U.S. Cl. ..... 173/29; 173/49; 173/90; 173/128; 173/131

(58) Field of Search ..... 173/91, 90, 29, 173/201, 212, 210, 131–133, 48, 128; 254/29 R, 30

(56) References Cited

U.S. PATENT DOCUMENTS

| | | | | |
|---|---|---|---|---|
| 1,024,173 | * | 4/1912 | Betts | 173/29 |
| 1,042,873 | * | 10/1912 | Betts | 173/131 |
| 1,202,551 | * | 10/1916 | MacKenzie | 173/29 |
| 1,213,989 | * | 1/1917 | Wilson | 173/29 |
| 3,356,166 | * | 12/1967 | Diachenko | 173/133 |
| 4,650,008 | * | 3/1987 | Simson | 173/91 |
| 4,790,392 | * | 12/1988 | Clements | 173/90 |
| 5,065,823 | * | 11/1991 | Gien et al. | 173/91 |
| 5,485,887 | | 1/1996 | Mandanis | 173/17 |
| 5,944,118 | * | 8/1999 | Johansson et al. | 173/212 |
| 6,003,619 | * | 12/1999 | Lange | 173/29 |

FOREIGN PATENT DOCUMENTS

| | | | | |
|---|---|---|---|---|
| 1198763 | * | 8/1965 | (DE) | 173/29 |
| 38 02 391 A1 | | 8/1988 | (DE) . | |
| 0 522 190 | | 1/1993 | (EP) . | |

* cited by examiner

*Primary Examiner*—Scott A. Smith
(74) *Attorney, Agent, or Firm*—Boyle Fredrickson Newholm Stein & Gratz S.C.

(57) ABSTRACT

An impacting device is capable of being used in an impact hammer and/or a drill for releasing by impact tools blocked in rocks. An impact impetus supplied by an impact piston is modified via an impact-deflecting device having a sliding lever and a deflecting lever, such that the impact is carried out in a releasing impact direction opposite the normal impact direction and is transmitted to a tool by a slide and a locking lever. The tool is released after a few strokes produced by the impact piston. The impact device is suitable for both unilateral air springs and double air springs.

13 Claims, 3 Drawing Sheets

IMPACTING DEVICE FOR RELEASING BLOCKED OBJECTS BY IMPACT

BACKGROUND OF THE INVENTION

1. Field of the Invention

The invention relates to a percussion apparatus according to the preamble of patent claim 1. The invention relates in particular to a percussion apparatus which can be used in an impact hammer and/or drill hammer.

When work is done using impact and drill hammers, the situation often arises where the tool, e.g. a cutter or a bit, wedges or jams in the rock. While a practiced operator can usually still prevent the tool from jamming during drilling with the drill hammer, it is not always possible, during demolition work using a large impact hammer, even for the expert to avoid wedging or jamming of the cutter. It is usually difficult to release a wedged tool because this can only be accomplished by using a second cutter, in the case of a certain hammer design only by using a second hammer, to release the jammed tool by impact. During the impact-release of a jammed bit, the effort necessary for this purpose is usually particularly high since the drill is already lodged deep in the rock and it is thus necessary to cut away all the rock around the drill hole. In any case, the impact-release of a jammed tool requires considerable outlay in terms of time and equipment.

2. Description of the Related Art

U.S. Pat. No. 5,485,887 discloses a percussion apparatus having an impact-generating device which has an axially reciprocating percussion piston. In an operating state, a tool can be forced in an operational-impact direction by the percussion piston while, in an impact-release state, a blow of the percussion piston can be transmitted to the tool such that said tool can be forced in an impact-release direction, which is counter to the operational-impact direction. The reversal of the impact direction is achieved purely pneumatically by the displacement of an outer piston, which encloses the percussion piston.

OBJECTS AND SUMMARY OF THE INVENTION

The object of the invention is to specify a percussion apparatus by means of which the impact-release of a jammed tool can be carried out in a straightforward and time-saving manner.

The object is achieved according to the invention by a percussion apparatus having the features of patent claim 1. Advantageous further developments of the invention are defined in the subclaims. Such a percussion apparatus can be used particularly advantageously in an impact hammer and/or drill hammer.

The invention relates to a percussion apparatus having an impact-generating device which has an axially reciprocating percussion piston, it being possible, in an operating state, for a tool to be forced in an operational-impact direction by the percussion piston, wherein, in an impact-release state, a blow of the percussion piston can be transmitted to the tool via an impact-converting device such that said tool can be forced in an impact-release direction, which is counter to the operational-impact direction.

The invention thus provides a percussion apparatus in which the impact energy of the percussion piston, which belongs to the impact-generating device, can be utilized for releasing the jammed tool from the rock again by impact, in that said tool is forced in a direction which is directed counter to the normal impact direction. The percussion piston usually strikes against the tool, in the operational-impact direction, directly or via an interposed riveting set. The impact-converting device makes it possible to pick up the movement of the percussion piston either in the operational-impact direction or in the impact-release direction and supply it to the tool in the form of a blow in the impact-release direction.

Particularly advantageous is an embodiment of the invention in which the blow is transmitted, and has its direction deflected, via the impact-converting device when the percussion piston forces the impact-converting device in the operational-impact direction. The percussion piston is usually designed such that it can absorb the greatest loading in the operational-impact direction, because it strikes against the tool during movement in this direction. This means that it can also withstand the loading necessary for the impact-release since, in this case, the forces and blows which are necessary tend to be smaller than in the operating state. For the further development of the percussion apparatus according to the invention, it is not necessary for a conventional percussion apparatus to be newly designed in terms of impact geometry and strength. Rather, the solution according to the invention can be achieved by the impact-converting device being added.

A particularly advantageous further development of the invention is defined in that the impact-converting device has an impact-deflecting device and an impact-transmission device; the impact-deflecting device has a deflecting lever which can be pivoted about a rotary pin, can be forced in the operational-impact direction at a first lever end by the percussion piston and is coupled to the impact-transmission device at a second lever end, which is located opposite in relation to the rotary pin and, accordingly, can be moved in the impact-release direction; and the impact-transmission device has a slide which can be moved in the impact-release direction as well as a tool locking mechanism which is fastened on the slide and transmits the blow to the tool.

The impact-deflecting device serves for picking up the blow which is delivered by the percussion piston and directed in the operational-impact direction and for deflecting said blow into a blow which is directed in the opposite, impact-release direction. The deflected blow is transmitted to the tool by the impact-transmission device, and the tool can then be released by impact.

The percussion piston moving in the operational-impact direction can advantageously act directly on the deflecting lever, which belongs to the impact-deflecting device.

Alternatively to this, the impact-deflecting device has, between the percussion piston and the deflecting lever, a sliding lever which can be displaced between an operating position and an impact-release position, can be pivoted about one of its ends and via which the percussion-piston blow in the operational-impact direction can be transmitted to the deflecting lever. On the one hand, the sliding lever permits the blow to be transmitted from the percussion piston to the deflecting lever with a geometry which is particularly advantageous in terms of the force transmission. In addition, the sliding lever can be displaced between the operating position and the impact-release position and thus serves as a changeover means between the operating state and the impact-release state, which the operator can select freely by adjusting the sliding lever.

In a preferred embodiment of the invention, the impact-generating device has a percussion mechanism with a pneumatic spring acting on one side. Said percussion mechanism, which is known per se, has the advantage of being very robust and straightforward to construct and has proven to be very successful in practice. Without any change in the design of the percussion mechanism being necessary, the percussion apparatus can be supplemented in the manner according to the invention by virtue of the abovedescribed features being added.

In another embodiment of the invention, the blow is transmitted via the impact-converting device when the percussion piston forces the impact-converting device in the impact-release direction. In this case, the percussion piston—in contrast to the embodiments described above—is already moving in the direction in which the tool is to be released by impact. This has the advantage that there is no need for any impact-deflecting device.

Rather, a particularly advantageous embodiment is defined in that the impact-converting device has an impact-transmission device; the impact-transmission device can be forced in the impact-release direction by the percussion piston and transmits the blow to a point which is located at the tool-receiving means; and fastened on the impact-transmission device is a tool locking mechanism which transmits the blow to the tool.

This arrangement makes it possible for the impact energy to be picked up from the percussion piston already moving in the impact-release direction and supplied to the tool, which is arranged in the opposite direction, in order to release said tool by impact.

It is particularly advantageous in this embodiment if, at a point which is located behind the percussion piston, as seen in the operational-impact direction, the impact-transmission device can be forced in the impact-release direction by the percussion piston when the percussion piston moves in the impact-release direction.

Quite particularly advantageous is an embodiment in which the impact-generating device has a percussion mechanism with a double-acting pneumatic spring. Such double pneumatic springs are known per se and have the advantage of starting reliably from a standstill and of not unduly stressing the material. Since, in the case of a pneumatic spring which acts on two sides, the percussion piston also moves in the impact-release direction in a defined manner, it is possible for the impact energy of said percussion piston to be picked up reliably and supplied to the tool.

It may be advantageous, in the case of all the previously mentioned percussion apparatuses, for the tool locking mechanism to have a locking lever which engages behind a collar belonging to the tool. Such a locking lever has usually already been provided in known percussion apparatuses, in order to secure the tool in the apparatus. For this reason, there is no need for any additional components for transmitting the impact energy to the tool for impact-release purposes. However, the locking lever has to be of sufficient dimensions to be able to withstand the dynamic loading during the impact-release operation.

It is particularly advantageous if the percussion apparatus can be changed over manually between the operating state and impact-release state. As has already been described above in conjunction with the sliding lever, it is thus possible for the operator himself to determine at any time the direction in which the impact action takes place. Manual changeover is also possible in the case of pneumatic springs which act on two sides and in which a coupling arranged between an electric motor and a crank mechanism, which energizes the pneumatic spring, can be activated via a control slide. It may be necessary here for the coupling to be bridged mechanically in the idling position, in order for it to be possible to change the percussion apparatus into the impact-release state.

The percussion apparatus according to the invention can be used particularly advantageously in an impact hammer and/or drill hammer.

BRIEF DESCRIPTION OF THE DRAWINGS

Further features and advantages of the invention are described hereinbelow, by way of preferred embodiments, with the aid of the figures, in which.

DESCRIPTION OF THE PREFERRED EMBODIMENTS

Figure 1:
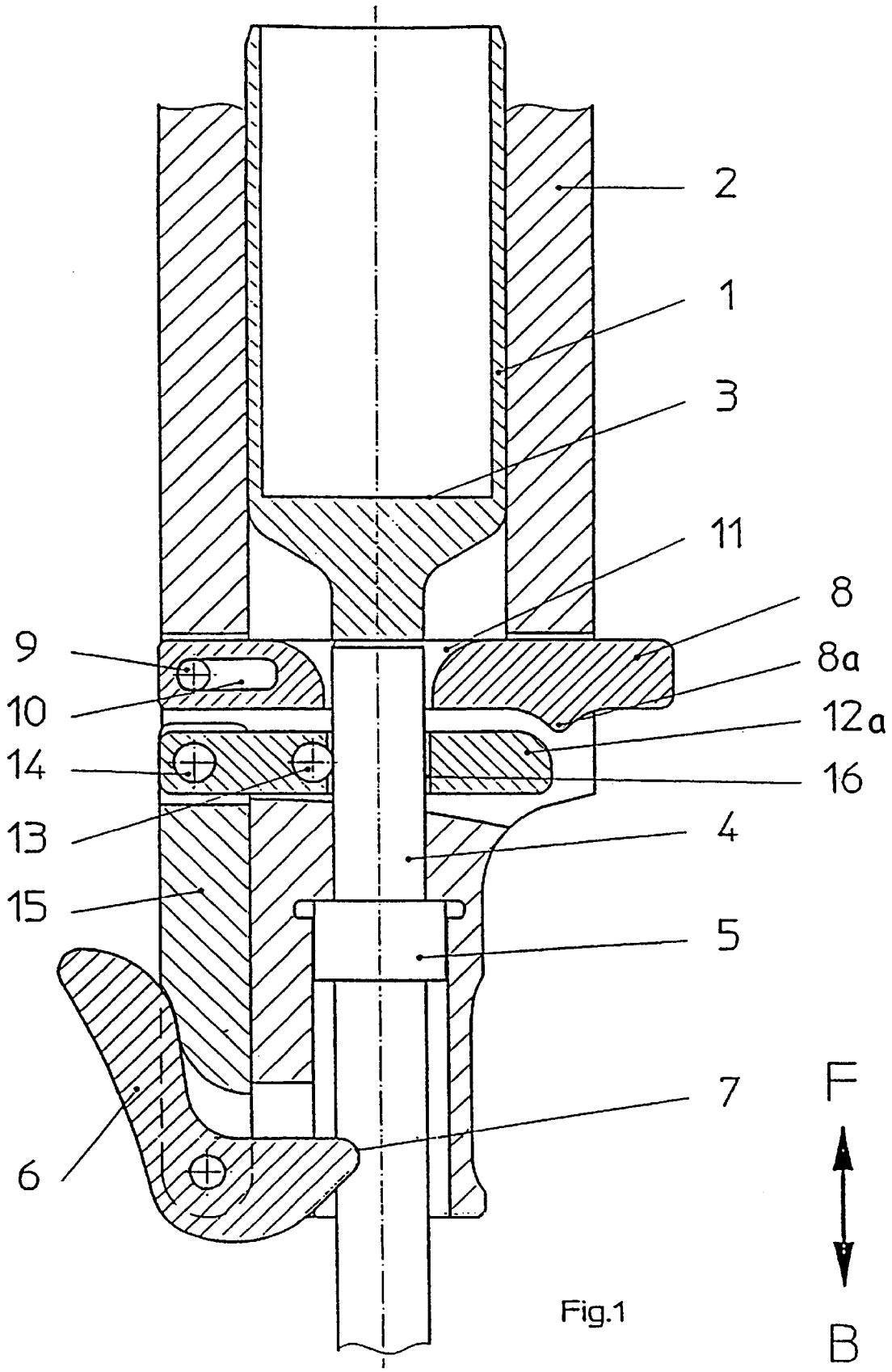
FIG. 1 shows a partial section of a percussion apparatus according to the invention in the operating state, said percussion apparatus having a pneumatic spring which acts on one side.

FIG. 1 shows a partial section through the percussion apparatus of an impact hammer, and, for reasons of simplicity, elements of an impact-generating device which are known per se has been left out of the partial section. There are no illustrations, in particular, of an electric motor, a crank mechanism driven by the electric motor, and a drive piston which can be moved axially by the crank mechanism and can be moved axially in a hollow-cylindrical recess of a percussion piston 1.

The percussion piston 1 is arranged such that it can be moved axially in a housing 2 of the hammer, and it is driven by the drive piston via a pneumatic spring formed between the drive piston and a closed end side 3 of the percussion piston 1. The percussion piston 1 thus follows the forced movement of the drive piston, which is coupled to the crank mechanism.

Whenever the percussion piston 1 reaches the extreme position shown in FIG. 1, in which the drive piston has driven it forward as far as possible (downward in FIG. 1), it strikes against a tool 4. The tool 4, for example a cutter, is inserted into the hammer and has a collar 5 which is secured via a locking lever 6. A spring (not illustrated) acts on the locking lever 6, with the result that a nose 7 always engages behind the collar 5 and retains the tool 4 in the housing 2. It is only when the locking lever 6 is actuated by the operator that the nose 7 can be pivoted out of the movement path of the collar 5 and the tool 4 can be removed from the hammer. This arrangement is known per se and will therefore not be discussed in any more detail here.

Figure 2:
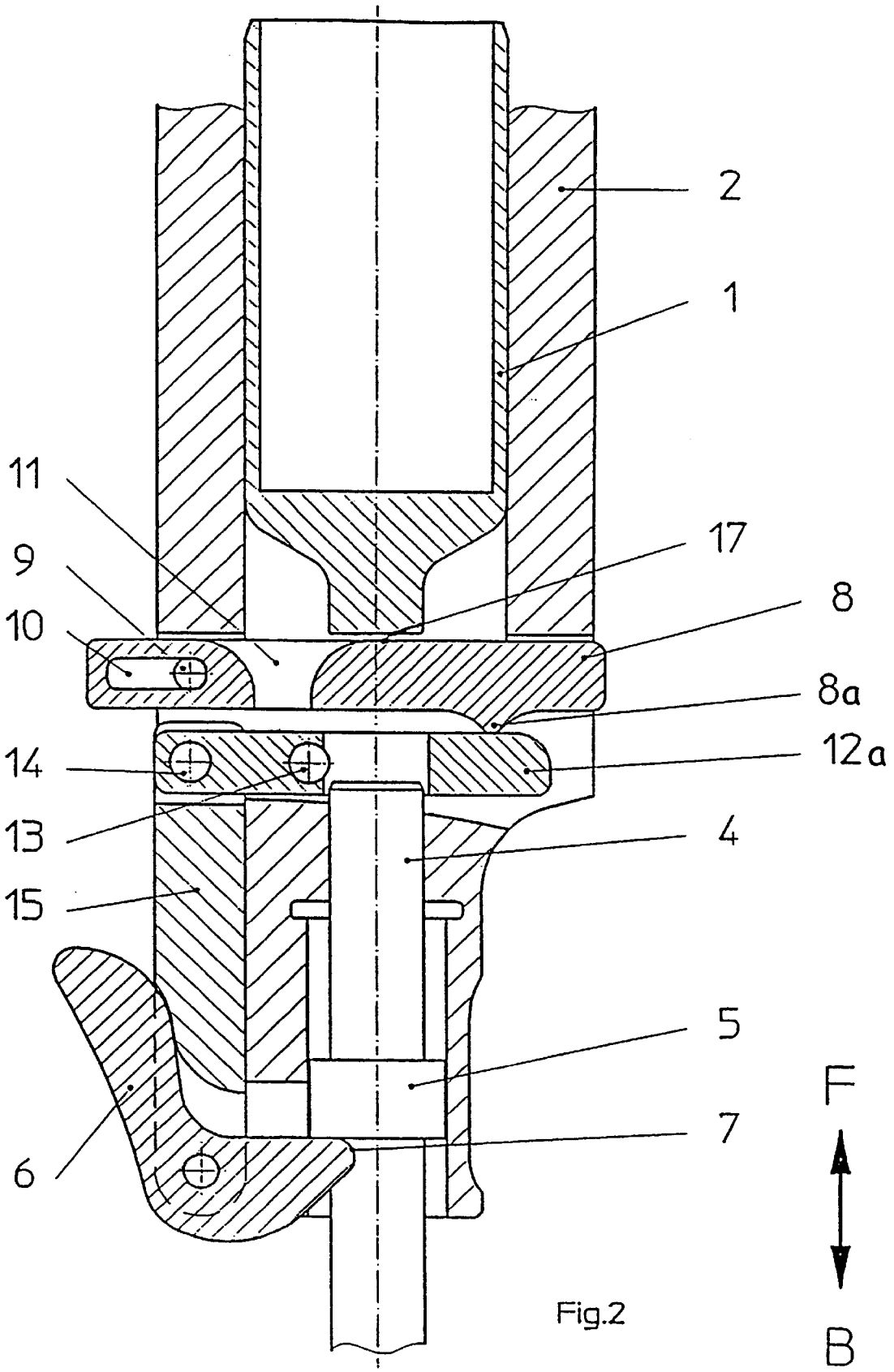
FIG. 2 shows a partial section of the percussion apparatus according to the invention in the impact-release state.

FIG. 2 shows an essentially similar section, in which the tool 4 is in the idling position and has slid out of the housing 2 to the extent where the collar 5 rests on the nose 7 of the locking lever 6.

In the idling position, which is shown in FIG. 2, it is no longer possible for the percussion piston 1 to reach the tool 4, with the result that it is no longer possible for any blow to be transmitted to the tool 4 either. It is only when the tool 4 is positioned on the rock which is to be worked that the tool 4 is pushed into the hammer again and reaches the position shown in FIG. 1.

The impact-converting device according to the invention is described hereinbelow.

In this embodiment, the impact-converting device has an impact-deflecting device for deflecting in the impact-release direction (arrow direction F) the blow which is delivered by the percussion piston 1 and is initially directed in the operational-impact direction (arrow direction B), and it also has an impact-transmission device for transmitting to the tool 4 the blow which is now directed in the impact-release direction F.

The impact-deflecting device comprising a sliding lever 8 which is fastened pivotably on a rotary stub 9 at one end and has its other end projecting out of the housing in the operating position, which is shown in FIG. 1. At the fastening with the stub 9, the sliding lever 8 has a slot 10 and can thus be displaced between the operating position, which is shown in FIG. 1, and an impact-release position, which is shown in FIG. 2. The positions may be changed in each case by virtue of the sliding lever 8 being pressed from the outside. In the operating position, which is shown in FIG. 1, one end of the tool 4 passes through a through-passage opening 11 of the sliding lever 8. The sliding lever 8 thus does not function in the operating state.

Arranged beneath the sliding lever 8 is a deflecting lever 12 which is retained approximately centrally in the housing 2 such that it can be pivoted about a rotary stub 13. At its opposite end, the deflecting lever 12 is coupled, by means of a pin 14, to a slide 15 belonging to the impact-transmission device. Furthermore, on one side of the rotary stub 13, the deflecting lever 12 has a through-passage opening 16 through which the end of the tool 4 can be guided without the tool 4 and the deflecting lever 12 coming into contact with one another.

The slide 15 is arranged such that it can be moved longitudinally in the housing 2 and, at the end located opposite the pin 14, it bears the locking lever 6 which is arranged pivotably on the slide 15 and can likewise be moved longitudinally therewith.

As has already been mentioned, FIG. 2 illustrates a section through the percussion apparatus according to FIG. 1, the percussion apparatus being located in an impact-release state. For this purpose, the operator has raised the hammer from the rock which is to be worked, with the result that the tool 4 slides into the idling position, which is shown in FIG. 2, until such time as it is retained at its collar 5 by the nose 7.

If the operator then realizes that the tool, in this case a cutter for example, has jammed in the rock, he displaces the sliding lever 8 out of the operating position into the impact-release position, which is shown in FIG. 2, as a result of which the through-passage opening 11 also moves to the side and, in its place, an impact surface 17 is arranged beneath the percussion piston 1.

The percussion piston 1, which is initially in the idling position and may also have slid some way into the through-passage opening 11, and of which the pneumatic spring is usually likely to have had an air extracted from it, is pushed back by the sliding lever 8, then passes into the operating position again and strikes against the impact surface 17 in the same way as the tool 4 was struck previously.

The blow of the percussion piston 1 is transmitted to the outer end of the deflecting lever 12 via a nose 8*a* by virtue of the sliding lever 8 pivoting about the rotary stub 9. Since the deflecting lever 12 is fastened pivotably on the rotary stub 13, that end of the deflecting lever 12 which is located opposite the point of impact initiation accordingly moves in the opposite direction with the rotary pin 14, i.e. in the impact-release direction F. The pin 14 carries along the slide 15 and thus also the locking lever 6 and the secured collar 5 of the tool 4, with the result that the tool 4 is forced in the impact-release direction F and is likely to be freed from the clamping state again after just a small number of blows.

It is obvious that the blow can be transmitted to the impact-deflecting device directly from the percussion piston or via an additional intermediate element. It is likewise obvious that transmission of the impact energy in the operational-impact direction B can take place from the percussion piston 1 either directly to the tool 4 or via an interposed riveting set (not illustrated).

Figure 3:
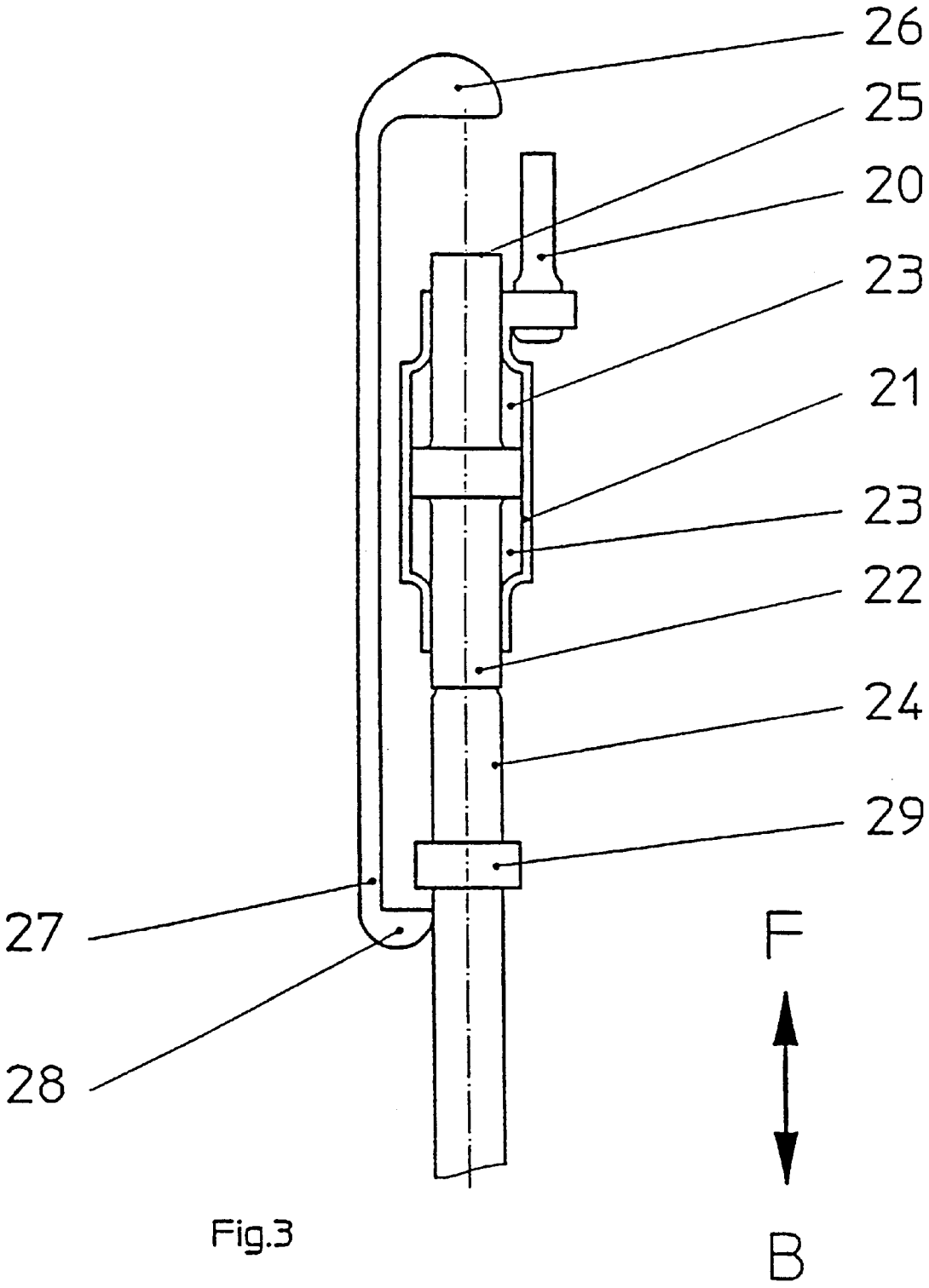
FIG. 3 shows a schematic illustration of another embodiment of the percussion apparatus according to the invention in the operating state, said percussion apparatus having a double pneumatic spring.

FIG. 3 schematically shows another embodiment of the invention, in which a double-acting pneumatic spring is used instead of the pneumatic spring which acts on one side, from FIGS. 1 and 2.

It is possible to see in FIG. 3 part of a connecting rod 20 which move a drive piston 21 back and forth. A percussion piston 22 follows the movement of the drive piston 21 in a known manner, a pneumatic spring 23 being formed respectively in front of and behind the percussion piston 22. This is the reason why said pneumatic spring is also referred to as a "double pneumatic spring".

The percussion piston 22 strikes against a tool 24 in a known manner. Alternatively to this, it is also possible for the percussion piston 22 to strike against a riveting set (not illustrated) arranged between the tool 24 and the percussion piston 22.

At its rear end 25, the percussion piston 22 has an extension which passes through the drive piston 21 in the rearward direction, as seen in the operational-impact direction B. Arranged behind the rear end 25 is a hook 26 of a slide 27 serving as an impact-transmission device, and the rear end of the percussion piston 22 acts on said hook when the percussion piston moves in the impact-release direction F. The impact energy in the impact-release direction F is transmitted to a collar 29 of the tool 24 via the hook 26 and the slide 27, via a locking element 28 (only illustrated in outline), with the result that the tool 24 can be released by impact.

When the hammer is raised from the rock, and the percussion apparatus starts to idle, the tool 24 slides—as has been described above—a certain distance out of the housing of the hammer. The slide 27 and the locking element 28 follow this sliding movement over a defined section and likewise move out of the housing. This means that the hook 26 passes into the movement region of the rear end 25 of the percussion piston 22, with the result that the impact energy of the percussion piston 22 may subsequently be transmitted to the tool 24 via the slide 27.

If the percussion apparatus should be provided with a coupling which interrupts the flux of force between the drive and the double pneumatic spring when the tool 24 assumes the idling position, it is, of course, necessary to provide bridging for the coupling or a switch for the manual actuation of the coupling, in order that the pneumatic-spring percussion mechanism can also be made to operate when the tool 24 is in the idling position.

The collar 29 of the tool 24 does not have to be locked directly by the locking element 28, which serves essentially for transmitting the impact energy, in the hammer. Rather, it may be expedient to provide a separate locking mechanism (not shown in FIG. 3) for the tool 24. In this case, the locking element 28 would serve exclusively for transmitting the impact energy in the impact-release direction F. The locking of the tool is thus to be regarded rather more as an additional function to the impact transmission.

What is claimed:

1. A percussion apparatus comprising:

an impact-generating device having an axially reciprocating percussion piston configured to drive a tool to move in an operational-impact direction;

an impact-converting device which is coupled to said impact generating device, which is integrated into said percussion apparatus, and which is switchable between an operational-impact position thereof and an impact-release position thereof, wherein, when the impact-converting, device is in the impact-release position thereof, a blow of the percussion piston is transmitted to the tool via the impact-converting device to force the tool in an impact-release direction, which is counter to the operational-impact direction, and wherein, when the impact-converting device is in the operational-impact position thereof, a blow of the percussion piston is transmitted to the tool via the impact-converting device to force the tool in the operational-impact direction; and a tool locking mechanism which is configured to lock the tool to the percussion apparatus and to retain the tool in its locked configuration when the tool is forced in the impact-release direction thereof.

2. The percussion apparatus as claimed in claim 1, wherein the impact-converting device includes an impact-deflecting device and an impact-transmission device; wherein the impact-deflecting device includes a deflecting lever which is pivotable about a rotary pin and which is forced in the operational-impact direction at a first lever end thereof by the percussion piston and is coupled to an impact-transmission device at a second lever end thereof which is located opposite the first lever end; wherein the rotary pin is disposed between the first lever end and the second lever end; wherein the second level end is movable in the impact-release direction; wherein the impact-transmission device has a slide which is movable in the impact-release direction; and wherein the tool locking mechanism comprises a portion of the impact-transmission device, is fastened on the slide and transmits the blow to the tool.

3. The percussion apparatus as claimed in claim 2, wherein the percussion piston acts directly on the deflecting lever when said percussion piston moves in the operational-impact direction.

4. The percussion apparatus as claimed in claim 2, wherein the tool locking mechanism includes a locking lever which engages behind a collar of the tool.

5. The percussion apparatus as claimed in claim 1, wherein the impact-generating device includes a percussion mechanism with a pneumatic spring acting on one side.

6. The percussion apparatus as claimed in claim 1, wherein the percussion apparatus can be changed over manually between the operating state and the impact-release state.

7. The percussion apparatus as claimed in claim 1, wherein said percussion apparatus can be used in at least one of an impact hammer and a drill hammer.

8. The percussion apparatus as claimed in claim 1, wherein the impact-converting device is manually switchable between the operational-impact position thereof and the impact-release position thereof.

9. The percussion apparatus as claimed in claim 1, wherein the percussion piston is coaxial with the tool both when the tool is driven in the operational-impact direction and in the impact-release direction.

10. A percussion apparatus for driving a tool, the percussion apparatus comprising: an impact-generating device having an axially reciprocating percussion piston, the percussion piston being movable in an operational-impact direction to drive a tool to move;

an impact-converting device which is coupled to the impact generating device and to the tool, which is integrated into the percussion apparatus, and which is switchable between an operational-impact position thereof and an impact-release position thereof, wherein, when the impact-converting device is in the operational-impact position thereof, movement of the percussion piston in the operational-impact direction drives the tool to move in the operational-impact direction, and wherein, when the impact-converting device is in the impact-release position thereof, movement of the percussion piston in the impact-release direction drives the tool to move in an impact-release direction which is counter to the operational-impact direction; and a tool locking mechanism which is configured to lock the tool to the percussion apparatus and to retain the tool in its locked configuration when the tool is forced in the impact-release direction thereof.

11. The percussion apparatus as claimed in claim 10, wherein the impact-converting device is manually switchable between the operational-impact position thereof and the impact-release position thereof.

12. The percussion apparatus as claimed in claim 10, wherein the percussion piston is coaxial with the tool both when the tool is driven in the operational-impact direction and in the impact-release direction.

13. A percussion apparatus comprising:

an impact-generating device having an axially reciprocating percussion piston configured to drive a tool to move in an operational-impact direction;

an impact-converting device which is coupled to said impact generating device and via which a blow of the percussion piston can be transmitted to the tool to force the tool in an impact-release direction that is counter to the operational-impact direction, wherein the blow is transmitted, and has its direction deflected, through the impact-converting device when the percussion piston forces the tool in the operational-impact direction; wherein the impact-converting, device includes an impact-deflecting device and an impact-transmission device; wherein the impact-deflecting device includes a deflecting lever which is pivotable about a rotary pin and which is forced in the operational-impact direction at a first lever end thereof by the percussion piston and is coupled to an impact-transmission device at a second lever end thereof which is located opposite to the first end, wherein the second lever end of the deflecting lever is movable in the impact-release direction; wherein the impact-transmission device includes (1) a slide which is movable in the impact-release direction and (2) a locking mechanism which is fastened on the deflecting lever; wherein the impact-deflecting device includes a sliding lever which is located between the percussion piston and the deflecting lever in operative communication with the percussion piston and the deflecting lever, which can be displaced between an operating position and an impact-release position, which is pivotable about one of its ends, and via which a percussion piston blow is transmitted to the deflecting lever to release the tool when the percussion piston moves in the operational-impact direction thereof and when the sliding lever is in the impact-release position thereof.

* * * * *